US005602354A

United States Patent [19]

Martin

[11] Patent Number: 5,602,354

[45] Date of Patent: Feb. 11, 1997

[54] ACOUSTICAL RHYTHM BOARD

[76] Inventor: Thomas E. Martin, 6229 Savannah Ave., Cincinnati, Ohio 45224

[21] Appl. No.: 397,358

[22] Filed: Mar. 2, 1995

[51] Int. Cl.[6] ..... G10D 13/08

[52] U.S. Cl. ..... 84/410; 84/743

[58] Field of Search ..... 84/723, 725, 730, 84/743, 402, 408–410

[56] References Cited

U.S. PATENT DOCUMENTS

| | | | |
|---|---|---|---|
| 4,168,646 | 9/1979 | May | 84/723 |
| 4,201,107 | 5/1980 | Barber, Jr. et al. | 84/743 |
| 4,226,156 | 10/1980 | Hyakutake | 84/730 |
| 4,242,937 | 1/1981 | Pozar | 84/725 |
| 4,924,741 | 5/1990 | Vollenweider | 84/730 |
| 5,056,403 | 10/1991 | Yamashita | 84/723 |
| 5,293,000 | 3/1994 | Adinolfi | 84/730 |
| 5,323,678 | 6/1994 | Yould | 84/743 X |
| 5,430,245 | 7/1995 | Rogers | 84/743 X |

*Primary Examiner*—William M. Shoop, Jr.
*Assistant Examiner*—Jeffrey W. Donels
*Attorney, Agent, or Firm*—Steven J. Rosen

[57] ABSTRACT

A rhythm board that is electronically amplified using at least one fixed pick-up unit, though more units may be used, installed internally on a resonator. The pick-up unit may be of the solid contact transducer type, dynamic microphone or condenser microphone type. A more particular embodiment of the present invention provides a hollow rhythm board made of wood and covered by a wooden top and bottom. The top is a sound board for being struck by the foot causing internal vibrations which are transferred to the pick-up via the resonator.

13 Claims, 3 Drawing Sheets

ACOUSTICAL RHYTHM BOARD

BACKGROUND OF THE INVENTION

1. Field of the Invention

This invention is an acoustical musical instrument for producing an amplified percussion sound which is to be played by a musician as accompaniment to the musician's primary instrument or played independently as a percussion instrument.

2. Description of Related Art

The prior art consists of electronic drums, which produce percussion sound electronically, commonly from digitally sampled percussion sounds. Typically, these devices are pre-programmed to play a specific rhythm part or operated by striking a diaphragm or pad with a pair of drumsticks. These electronic drums also suffer from the disadvantage that the sound, which is amplified, is digitally rather than acoustically produced.

SUMMARY OF THE INVENTION

An acoustical musical instrument is a rhythm board that is electronically amplified using at least one fixed pick-up unit, though more units may be used, installed internally on a resonator. The pick-up unit may be of the solid contact transducer type, dynamic microphone or condenser microphone type. A more particular embodiment of the present invention provides a hollow rhythm board made of wood and covered by a wooden top and bottom. The top is a sound board for being struck by the foot causing internal vibrations which are transferred to the pick-up via the resonator. Another more particular embodiment of the present invention includes two hollow chambers, one larger and one smaller, which upon the acoustical musical instrument being played results in two distinct pitches, one lower and the other higher. Thus, the performer can alternate the sound by simply striking the board surface in a slightly different area. Although the main structural material housing the electronic pick-up and the sound chambers can be constructed of any number of possible types of rigid material, the sound board itself requires a certain amount of resonance and is found to be best enhanced by the use of wood.

The signal is transmitted by standard hi-Z shielded cord connected with a ¼ inch phone type jack to an independent amplifier source. A female ¼ inch phone jack is mounted on a large bout end of the board for external amplification source connection. The amplifying element is mounted on a resonator composed of metal which is partially shielded in wood. The resonator is mounted at the point at which the two sound chambers meet and is so mounted as to permit it to vibrate when the sound board is struck.

Therefore, in one compact, simple and economical unit, a true acoustic instrument is created which when used in conjunction with the performance of a primary instrument becomes a dynamic expressive rhythm accompaniment played by simply tapping the foot.

ADVANTAGES OF THE INVENTION

The present invention provides several advantages over the prior art. First, the construction is far simpler and more economical than that required by any existing rhythm accompaniment devices. This device consists of a sound chamber constructed of wood, metal and/or synthetic material with a transducing element mounted on a resonator. This invention functions without any internal power source.

Another great advantage of the instant invention is that it provides several advantages to the existing triggered percussion instruments. The acoustical nature of the invention provides nearly infinite variability of the sound to be amplified, depending, inter alia, on the configuration of the invention and its sound chamber, the portion of the instrument which is struck, and the force with which the instrument is struck.

Among the advantages of the present invention is its small and compact design which provides an acoustic rhythm instrument playable by the foot while contemporaneously playing a separate instrument with the hands. While the instant invention could certainly be played by striking it with sticks, it is designed to be played by either tapping it with the foot, or by rocking it so as to cause one end to strike the floor, thereby, permitting the musician to create a true acoustic percussion accompaniment while his/her hands are occupied with a guitar, keyboard or other instrument.

Another advantage of the present invention is its ability to provide a true acoustic instrument sound and the ability to permit dynamics of sound to be controlled by the performer's style and intensity without having to adjust any electronic amplified settings once the original volume and tone settings are made.

Yet another advantage of the present invention is to provide an acoustic instrument that contains no mechanically moving parts, thus, enabling the invention to be produced more economically requiring little or no maintenance.

The novel features of the present invention, together with its further objectives and advantages, is demonstrated by reference to the detailed description and drawings of the invention. However, the drawings are for purposes of illustration and description only and, not intended to define the limits or boundaries of the invention.

BRIEF DESCRIPTION OF THE DRAWINGS

The foregoing aspects and other features of the invention are explained in the following description, taken in connection with the accompanying drawings where.

Figure 1:
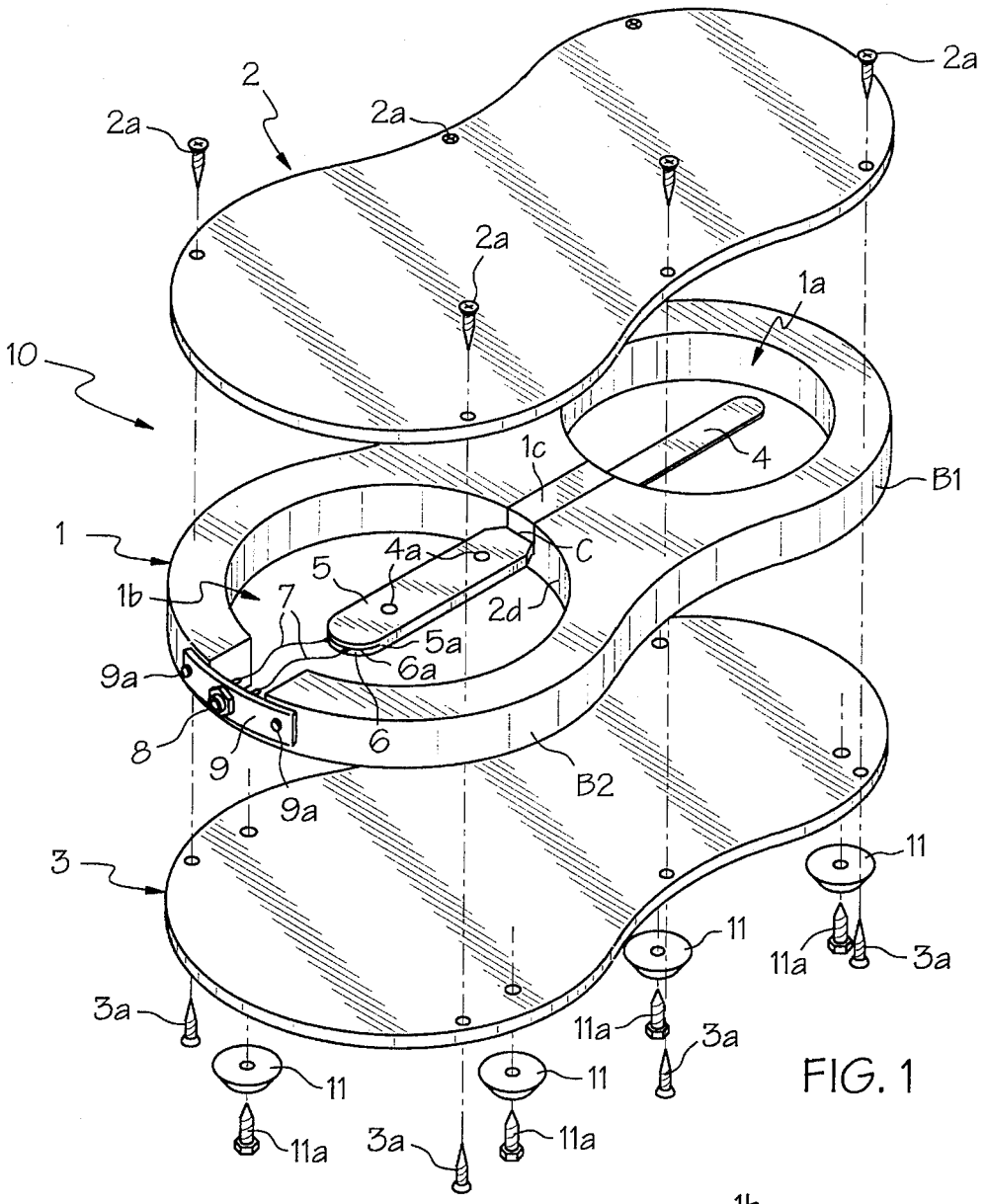
FIG. 1 is an exploded perspective view of an acoustical instrument in accordance with a first embodiment of the present invention.

It is to be understood that the form of the invention herewith shown and described is to be taken as a preferred embodiment. Various changes may be made in the shape, size and arrangement of parts, for example: equivalent elements may be substituted for those illustrated and described herein, parts may be reversed and certain features of the invention may be utilized independently of the use of other features all without departing from the spirit or scope of the invention as defined in the subjoining claims.

In describing the preferred embodiment of the invention illustrated in the drawings, specific terminology will be resorted to for sake of clarity. However, it is not intended to be limited to the specific terms so selected and it is to be understood that each specific term includes all technical equivalents which operate in a similar manner to accomplish a similar purpose.

DETAILED DESCRIPTION OF THE INVENTION

Figure 2:
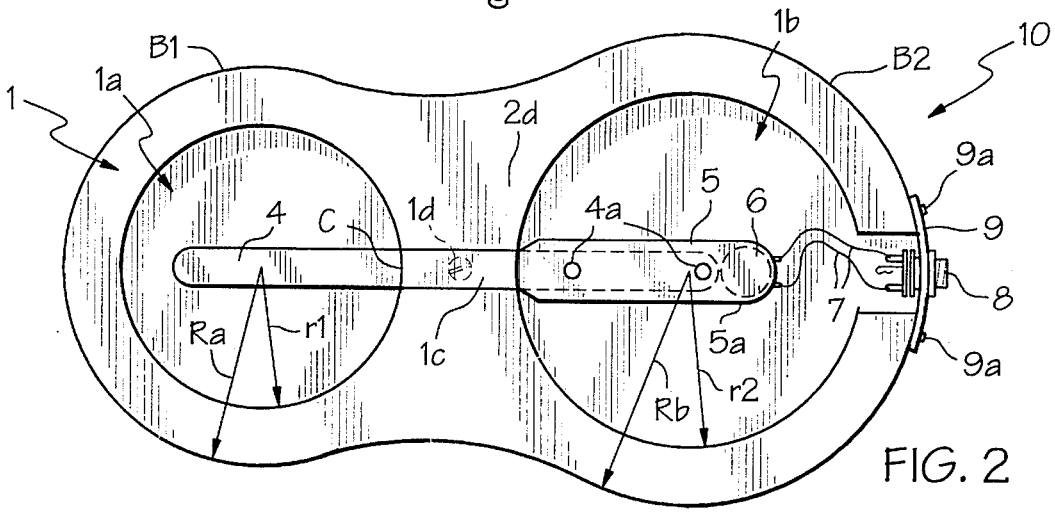
FIG. 2 is a top view of the acoustical instrument in FIG. 1 with the top cover section removed.
Figure 4:
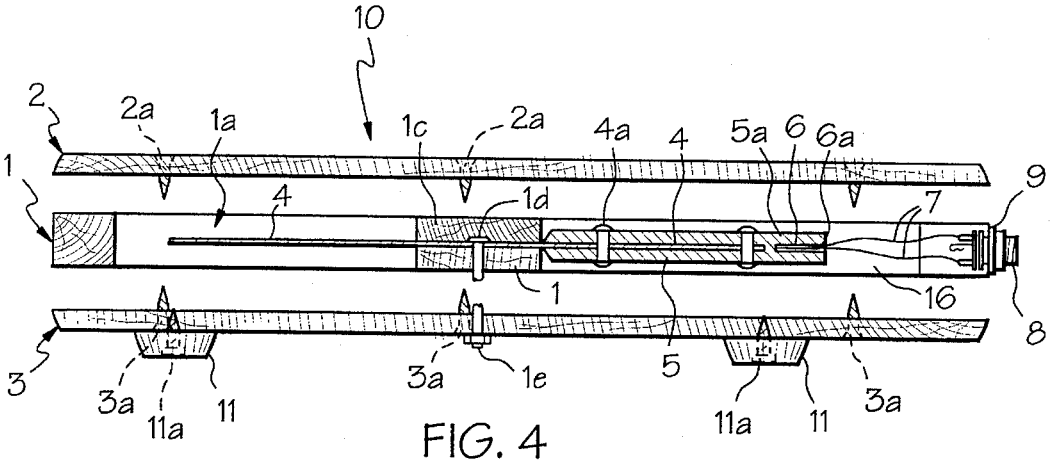
FIG. 4 is an exploded side view of the acoustical instrument in FIG. 1.

Referring to the FIGS. and, more specifically, to FIG. 1, there is shown a first embodiment of the present invention acoustical rhythm board 10. The acoustical rhythm board 10 has a housing including middle, top and bottom wooden sections 1, 2 and 3 respectively. The top section 2, which serves as a sound board, is secured to the middle section 1 by six (6) enclosure fastening screws 2*a* and the bottom section 3 is affixed to the middle section 1 by six (6) enclosure fastening screws 3*a*, as shown in FIGS. 1 and 4. The middle section 1 contains hollow first and second acoustic chambers 1*a* and 1*b*, respectively as shown in FIG. 2, which are separated by a wood wall 2*d* of the middle section 1 and which are circular in cross-section. The first acoustic chamber 1*a* and its first inner radius r1 are slightly smaller in size than the second acoustic chamber 1*b* and its second inner radius r2 in relative accordance with the exterior first and second radii Ra and Rb of smaller and larger bouts B1 and B2, respectively. The wooden middle section 1 contains a channel C wide enough and deep enough to accept a resonator 4 as seen in FIGS. 2 and 4, so as to effectively suspend the resonator 4 below the top section 2 and above the bottom section 3, best observed in FIG. 4.

Figure 6:
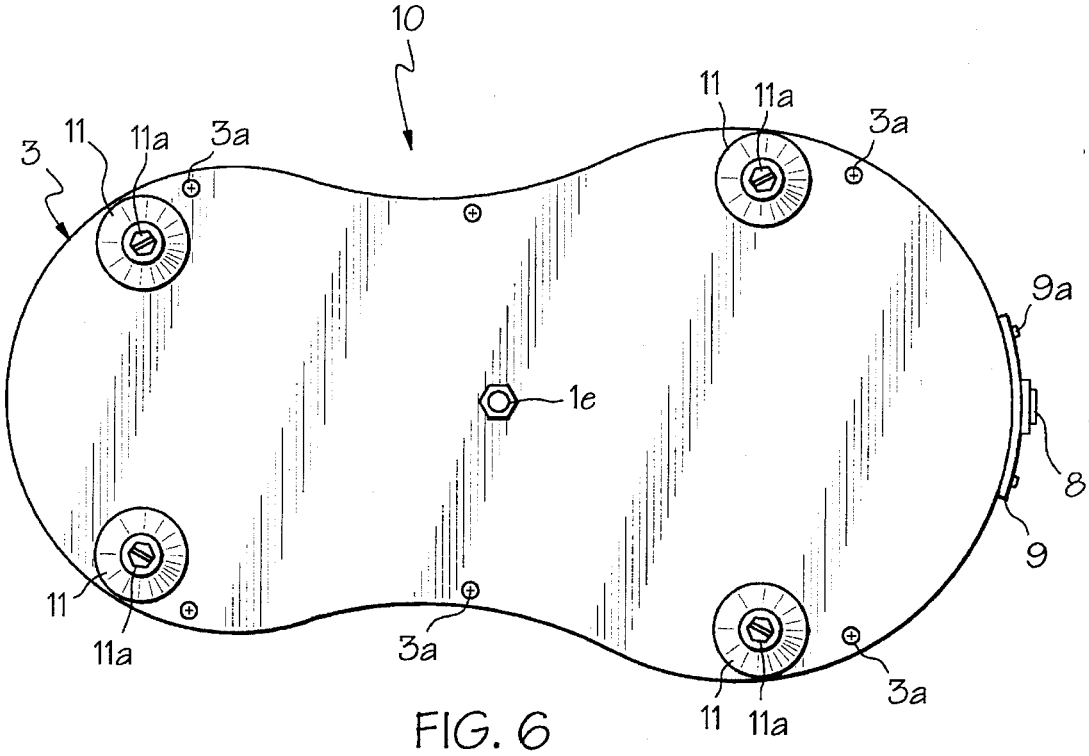
FIG. 6 is a bottom view of the acoustical instrument in FIG. 1 showing location of rubber feet and resonator nut.

The resonator 4 is made of a thin rigid flat metal strip extending from the first acoustic chamber 1*a* through the channel C in the middle section 1 into second acoustic chamber 1*b* as shown in FIGS. 2 and 4. A wood enclosed end 5 of resonator 4 extends into the acoustic chamber 1*b* and is secured by two rivets 4*a*. The resonator is held tightly in place with a small bolt 1*d*, which passes through the resonator 4, the bottom of the channel in section 1 and section 3, and is fastened with a hex nut 1*e* as seen in FIGS. 2, 4 and 6. Additionally, the resonator 4 of the present invention is held in place with a small wooden block 1*c* in FIGS. 2 and 4, which compresses onto resonator 4 when top section 2 is fixed in place, creating optimum continuity of vibrations to the resonator 4 when the acoustical rhythm board 10 is struck.

Figure 7:
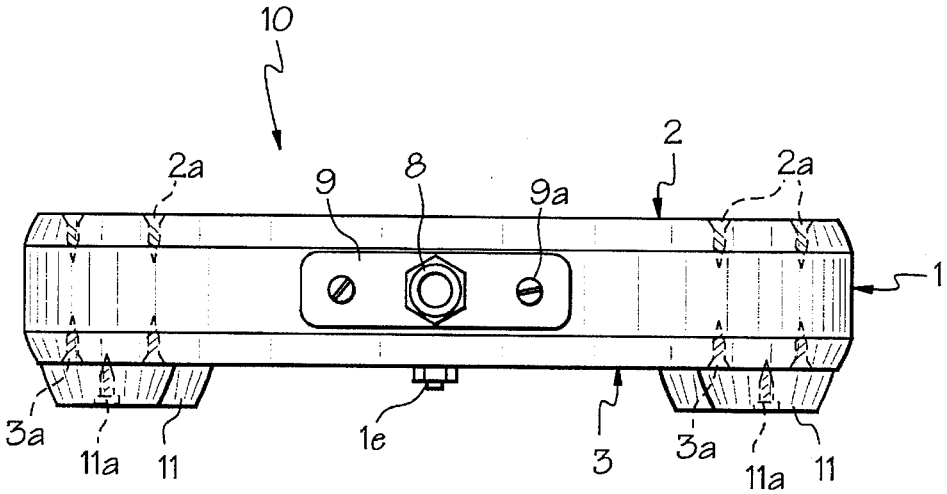
FIG. 7 is an end view of the acoustical instrument in FIG. 1 showing the connection jack and the mounting plate.

A piezo-electric transducer pick-up element 6 is mounted in a wood enclosure 5*a* of the wood enclosed end 5 of the resonator 4 in the larger second acoustic chamber 1*b* as shown in FIGS. 2 and 4. The piezo-electric transducer pick-up element 6 is connected by positive and negative wire leads 7 to a female ¼ inch phone jack 8. The phone jack 8 is held in place with a metal plate 9 externally mounted using two (2) screws 9*a* as shown in all FIGS., most visibly in FIG. 7. The piezo-electric transducer element 6 is inserted into a tight slot 6*a* cut into the wood enclosure 5*a* of the resonator 4 such that it is compressed by the wood enclosure that encloses the wood enclosed end 5, as seen in FIGS. 2 and 4, so as to achieve a high degree of motion sensitivity. The vibrations caused by striking the acoustical rhythm board 10 of the present invention are thus transferred to the piezo-electric transducer 6 via the resonator being excited into motion resulting in a variety of acoustic drum sounds depending upon where the invention is struck, the force with which it is struck, and the manner in which it is struck. The electronic signals generated by the acoustical vibrations of the resonator 4 are electronically transmitted to an external amplification source by way of the ¼ inch jack 8 and a separate ¼ inch male phone plug and appropriate shielded cable (not shown).

Figure 3:
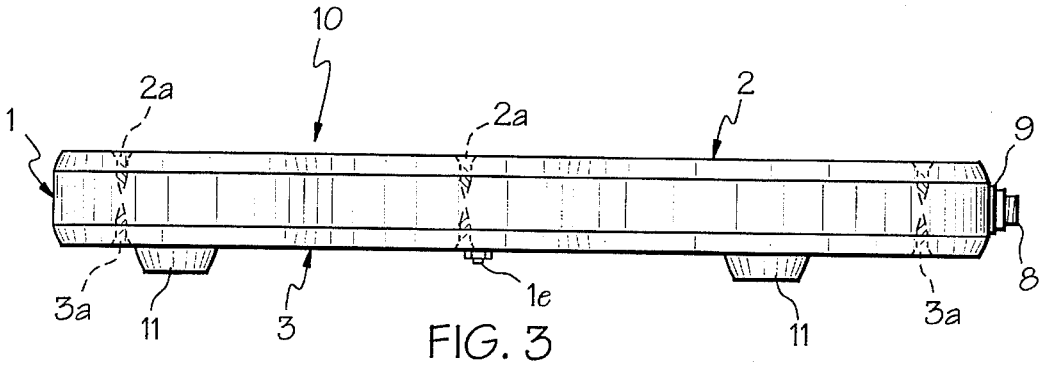
FIG. 3 is a side view of the acoustical instrument in FIG. 1.
Figure 5:
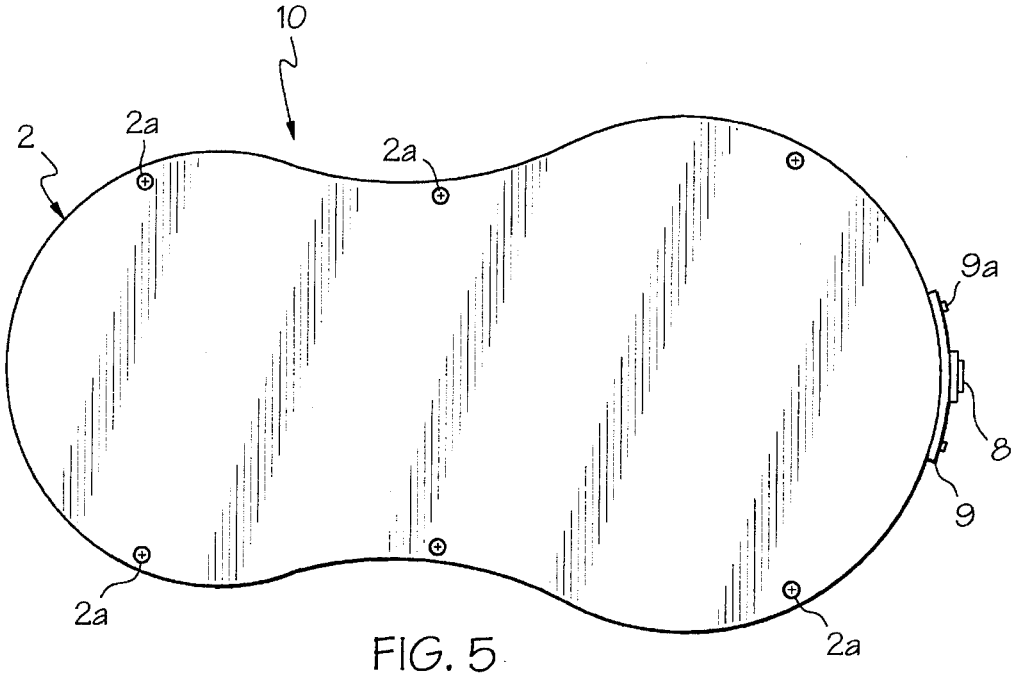
FIG. 5 is a top view of the acoustical instrument in FIG. 1 with the top cover section in place.

FIG. 3 shows a side view of the acoustical rhythm board 10 and the small rubber feet 11. FIG. 6 shows the location of the feet 11 mounted on the bottom of section 3. The enclosure fastening screws 3*a* are shown in FIGS. 3, 4 and 6. Also noted in FIG. 6 are the rubber feet mounting screws 11*a*. FIG. 5 is a top view of the acoustical rhythm board 10 and the location of the enclosure fastening screws 2*a*.

What is claimed is:

1. An acoustical rhythm board comprising:

a housing containing a hollow acoustic chamber, a resonator mounted within said chamber, and said resonator comprising a rigid flat strip and having mounted upon it at least one transducer for producing electronic signals generated by acoustical vibrations of the resonator.

2. A rhythm board as claimed in claim 1, wherein said resonator further comprises a thin rigid flat metal strip.

3. A rhythm board as claimed in claim 2, wherein said transducer is enclosed in a wooden enclosure which encloses one end of said strip.

4. A rhythm board as claimed in claim 1, wherein said housing further comprises:

two hollow acoustic chambers with a wall having a channel therebetween, said resonator is sufficiently long to extend from a first one to a second one of said chambers, and said resonator is secured to said wall in said channel.

5. A rhythm board as claimed in claim 4, wherein said resonator further comprises a thin rigid flat metal strip.

6. A rhythm board as claimed in claim 5, wherein said transducer is enclosed in a wooden enclosure which encloses one end of said strip.

7. A rhythm board as claimed in claim 4, wherein said housing further comprises:

a top section, a bottom section, and a middle section therebetween, said middle section including said hollow chambers and said wall, and said top section is a sound board.

8. A rhythm board as claimed in claim 7, wherein said resonator further comprises a rigid flat strip.

9. A rhythm board as claimed in claim 7, wherein said resonator further comprises a thin rigid flat metal strip.

10. A rhythm board as claimed in claim 9, wherein said transducer is enclosed in a wooden enclosure which encloses one end of said strip.

11. A rhythm board as claimed in claim 10, wherein said middle section is made from wood.

12. A rhythm board as claimed in claim 11, wherein said housing further comprises:

first and second bouts containing said first and second hollow chambers respectively, and said first and second hollow chambers being circular in cross-section.

13. A rhythm board as claimed in claim 12, wherein said first and second hollow chambers have first and second circular cross-sections with first and second radii respectively, and said first radius is larger than said second radius.

* * * * *